US007007978B1

(12) United States Patent
Purdom

(10) Patent No.: US 7,007,978 B1
(45) Date of Patent: Mar. 7, 2006

(54) SKATE ACTIVITIES RAIL SUPPORT

(76) Inventor: Erik Purdom, 38821 SE. Gibson Rd., Washougal, WA (US) 98671

( * ) Notice: Subject to any disclaimer, the term of this patent is extended or adjusted under 35 U.S.C. 154(b) by 0 days.

(21) Appl. No.: 10/856,321

(22) Filed: May 27, 2004

(51) Int. Cl.
*A63C 3/00* (2006.01)

(52) U.S. Cl. ..... 280/809; 256/65.15; 256/65.01; 256/65.02; 248/49

(58) Field of Classification Search ..... 280/809; 256/65.15, 59, 65.01, 65.02, 65.1, 65.14; 248/49; 292/339, 288
See application file for complete search history.

(56) References Cited

U.S. PATENT DOCUMENTS

| | | | | |
|---|---|---|---|---|
| 3,083,964 | A | 4/1963 | Wentzel | |
| 3,580,568 | A | 5/1971 | Stone | |
| 5,180,349 | A | 1/1993 | Marcus | |
| 5,718,412 | A | 2/1998 | Levanas | |
| 6,547,221 | B1 * | 4/2003 | Bork et al. | 256/65.01 |
| 6,551,192 | B1 * | 4/2003 | Rieber et al. | 472/88 |
| 6,648,805 | B1 | 11/2003 | Millis | |
| 6,782,577 | B1 * | 8/2004 | Rieber et al. | 14/71.1 |
| 6,866,445 | B1 * | 3/2005 | Semler | 404/119 |
| 2002/0027224 | A1 | 3/2002 | Labelson | |
| 2002/0050589 | A1 | 5/2002 | Nestel | |
| 2003/0196308 | A1 | 10/2003 | Kelsey | |

FOREIGN PATENT DOCUMENTS

WO PCT/US97/23788 12/1997

* cited by examiner

*Primary Examiner*—J. Allen Shriver
(74) *Attorney, Agent, or Firm*—Thomas I. Rozsa; Tony D. Chen

(57) ABSTRACT

A portable lightweight grind rail assembly formed of a tube supported on a multiplicity of spaced apart tube supports, each tube support having a base, a tube receiving surface and tube receiving mechanism which retains a portion of the tube on the tube receiving surface.

23 Claims, 9 Drawing Sheets

SKATE ACTIVITIES RAIL SUPPORT

BACKGROUND OF THE INVENTION

1. Field of the Invention

The present invention relates to a device for use in skateboarding, skating activities and grinding. More specifically, the invention relates to an apparatus for facilitating the performance of tricks and stunts by skateboarders, skaters and grinders.

The sports of skateboarding, conventional roller-skating and inline skating have continued to increase in popularity since their inception decades ago. Each of these activities allows the participants the option of not only rolling on wheels that are mounted on the skate or skateboard but also the ability to slide across a raised surface such as the top of a common stair rail, edge of a street curb, back of a bus stop bench, etc. When sliding across these raised surfaces, it is common that the skateboard's or skate's wheels are not used as the point that is slid across the surface rather the area of either of these devices that is used is the bottom surface of the board or skate itself, or the components that hold the wheels in place commonly known as trucks. This activity is known as "Grinding" and continues to be a popular element in this category of sports.

2. Description of the Prior Art

Grinding, as previously described, has been so popular that specialized shoes have been developed for the grinding activity that have "Grind plates" mounted on the soles to facilitate grinding with the shoes themselves without the need to use a skateboard and skate of any kind. These shoes are similar to those disclosed in U.S. Pat. No. 5,970,631.

Recreational parks, which are specially equipped for these activities, are called "skate parks". Skate parks offer a variety of challenging installations including grind surfaces for use by grinders, skateboarders and skaters. Unfortunately, these skate parks are costly to build and many communities and towns do not have the ability to provide them for use by the predominantly teenage and young adult population who would utilize them. For this reason, skate parks are usually few and far between. This requires the skateboarders, skaters and grinders to seek out other areas and obstacles to utilize for their sport. The areas and obstacles they usually find to utilize are public and private properties.

Unfortunately, not all skateboarders, skaters and grinders practice their sport in ways that are respectful of people or property. The general public, as well as local officials continue to complain and express concern about physical property damage in the form of scratched, marred and/or broken stair rails, benches and concrete surfaces as the result of being used for grind surfaces. Some business owners maintain that the presence of skateboarders, skaters and grinders in proximity to their places of business reduce their customer traffic and increase property owner's liability for the personal injury of the skateboarders, skaters or grinders and damage to their property.

The typical obstacles that are either provided at skate parks or found on public and private property are usually surrounded by concrete surfaces, which are unforgiving in the event that a skateboarder, skater or grinder falls against them or falls to the ground. Many rail obstacles particularly on private or public property are also at least 36" above the surrounding surface they project up from, which increases the likelihood of serious injury if an individual falls from the top of them. Many of these rails are erected to prevent persons from falling from the surface they are standing on to a significantly lower surface in an attempt to limit injury from falling from one level to another. An individual who is grinding across the top of these types of rail installations risks serious injury and even death due to severe injuries if they fall from the top of the rail surface.

The activity of grinding in and of itself is harmless. Many teenagers are discouraged or forbidden to participate in grinding by their parents due to the problematic factors discussed here and mainly due to the severe risk of serious injury.

Many potential grind rail type surfaces are either the wrong profile, wrong material, not long enough or other wise not optimally suited for proper grinding and therefore don't offer the performer of the grinding activity a satisfactory experience. Potential grind surfaces that are desirable to utilize are often located in areas and positioned in such a way as to increase the likelihood of injury to the individual who is grinding as well as proximal, non-participating embers of the community.

There are existing materials that are commonly used in the fabrication of rails and tubular assemblies that may be used by consumers to create their own grind surfaces. Steel tube is the traditional material used in grind rail construction for skate parks and for stand-alone grind rails. Typical materials come in the form of lengths of metal tube of various profiles. These materials can be used to fabricate freestanding grind surfaces. The difficulty with this method is that the consumer must possess the ability and the machinery to fabricate, cut and weld metal components together. Even more specialized machinery is required to bend these metal profiles in arcs of differing lengths to change the trajectory of the grind surface to create the opportunity to perform additional stunts or tricks.

Many brands of steel grind rails exist and can be readily purchased. All of these use the commonly accepted round tube, box tube or u-channel steel that are bolted or welded to 2 or more stands of similar materials. These grind rails typically range from 6 to 10 feet in length. Most of these have straight grind surfaces, meaning that their grind surfaces follow one trajectory. Some have sections that angle upward or downward to facilitate performing differing tricks or stunts.

All of the grind rails with removable stands use welded on fixtures or fabricated boltholes on the bottom side of the grind rail to facilitate connection to the removable stands. This limits the ability to arrange the stands where they best serve the needs of the consumer.

All of the grind rails using steel components are typically very heavy and cumbersome to transport.

Any steel grind rail surface can become marred by contact with other metal surfaces that are slid across or impact it. The marring in the surface of steel can create a cutting or filing surface that rapidly wears the bottom or skateboards, skates and grind shoes or other athletic equipment. This rapid wear can severely lessen the usable life of these types of costly athletic equipment.

Some do-it yourselfers have built grind rails using plastic tube such as schedule 40 rigid PVC conduit tube material. This is a common commodity material in a form that is found at typical hardware and building supply retailers. PVC offers excellent grind characteristics. This plastic tube is not commonly used for the purpose of grinding since it is not as rigid as metal tube and requires fabrication of either a continuous support or numerous supports under it to solidify its structure to bear the weight of a human standing upon it. Currently, a device doesn't exist that provides an all in one, quick and easy way to attach the PVC tube to an underlying support that doesn't require hardware fasteners or chemical bonding.

Many play devices utilize small parts and hardware to affix individual components together into an assembly. Often times, the special tools that are needed to affix fasteners are not readily available. Numerous small parts are misplaced and not available to complete the final assembly of the device prior to utilization. A system that utilizes the fewest parts, hardware and use of tools for assembly has a competitive edge in the marketplace.

The following ten prior art patents and published patent applications are relevant to the field of the present invention:

1. U.S. Pat. No. 3,083,964 issued to Wentzel on Apr. 2, 1963 for "Amusement Device" (hereafter the "Wentzel Patent");
2. U.S. Pat. No. 3,580,568 issued to Stone on May 25, 1971 for "Tightrope Device" (hereafter the "Stone Patent");
3. U.S. Pat. No. 5,180,349 issued to Marcus on Jan. 19, 1993 for "Simulated Tightrope Walking Apparatus" (hereafter the "Marcus Patent");
4. U.S. Pat. No. 5,718,412 issued to Levanas on Feb. 17, 1998 for "Portable Skating Rail" (hereafter the "Levanas Patent");
5. United States Patent Application Publication No. U.S. 2002/0027224 A1 to Labelson on Mar. 7, 2002 for "Method And Apparatus For Converting Standard Lumber Into A Grinding Rail" (hereafter the "Labelson Patent");
6. United States Patent Application Publication No. U.S. 2002/0050589 A1 issued to Nestel on May 2, 2002 for "Portable Grind Rail Assembly" (hereafter the "Nestel Patent");
7. United States Patent No. U.S. Pat. No. 6,547,221 B1 issued to Bork on Apr. 15, 2003 for "Knock-Down Grind Rail For Skateboards And Rollerblades" (hereafter the "Bork Patent");
8. United States Patent Application Publication No. U.S. 2003/0196308 A1 to Kelsey on Oct. 23, 2003 for "Grind Rail And Transport Kit" (hereafter the "Kelsey Patent");
9. United States Patent No. U.S. Pat. No. 6,648,805 B1 issued to Millis on Nov. 18, 2003 for "Collapsible Grind Bar" (hereafter the "Millis Patent");
10. PCT Application No. PCT/US97/23788 filed on Dec. 31, 1997 for "Traffic Cone Adapter Kit" (hereafter the "'23788 PCT Application").

The Wentzel Patent discloses an amusement device. There are sections of tubing which can either be rectangular or flat in cross section as illustrated in FIGS. 1 through 4 or alternatively, rounded in cross section as illustrated in FIGS. 5 through 8. The concept of this invention was to create a device for children to climb and walk along various narrow elongated objects. It is designed to simulate walking along fences, walls or curves.

The object of the invention is to provide an amusement or exercise device which can be stored and knocked down and then reassembled at the location for the children. As discussed in Column 2 beginning on Line 6, the triangular members can be made of any suitable material such as wood, metal or plastic. In the case of the embodiment as shown in FIGS. 5 and 6, the rails are supported by strap-like members as discussed in Column 2, lines 64 through 72, and Column 3, lines 1 and 2. There are also central struts 30 which provide interior support. This patent discloses the concept of having portable devices which can support along variations of separate support members an elongated tube member which can be either square or flat in top cross section or rounded in cross section for the purposes of enabling someone to walk on them.

The Stone Patent discloses a tightrope device which consists of a pair of separately supported block members 28 which support an elongated support member 4 which in turn has a grooved upper surface which supports a tightrope or rope 14 which is attached by various means such as adhesive or nails or other fasteners 18 as best illustrated in FIG. 3. The invention discloses the concept of having support members which support a tightrope so that one can walk on the tightrope.

The Marcus Patent also discloses a simulated tightrope. The simulated tightrope walking apparatus consists of a beam 10 which may be 10 to 12 ft in length and supported above a playing surface 12 such as an exercise mat or the ground on a pair of support members 14 and 16. The feel of a tightrope is simulated by a beam consisting of two elongated hollow tubes, preferably made of fiberglass for its tensile strength and flexibility, with one tube 26 loosely fitted within the other 24, as illustrated in FIG. 2.

The Levanas Patent discloses a portable skating rail. It is a modular series of square or tubular rails which are joined together by rigid or flexible connectors to provide a playing surface for in-line skates and skateboards. The rail section as illustrated in FIG. 5 can be circular and fit within a groove on a support block as also illustrated in FIG. 5. FIG. 8 shows a cross sectional view of a removably attached rail/column interface with a V-shaped support column. The rail be fixedly or removably attached to the support columns.

The Labelson Published patent application is a portable grinding rail assembly for use with skateboards, in-line skates, and the like. The assembly includes a beam that according to the inventor, is preferably made of stock wood, such as a two-by-four having support legs attached to each end of the beam. The assembly includes a cover or cap that sits on top of the beam and provides a riding surface for the skates. The cover and the support legs are removable from the beam so that the assembly is easily transported and to allow sale and shipment of the support legs and cover separately from the beam. The cover can also be L-shaped for use with existing, stationary supports, such as roadway curbs.

The Nestel Patent Application discloses a portable grind rail assembly. It includes a grind rail, two base portions, and two T-sections. each of the two base portions includes a planar ground-contacting surface for supporting the base portions above a ground surface. Each of the two T-sections is adapted for connecting one of the two base portions with the grind rail for supporting the grind rail above the ground surface. The grind rail is constructed of multiple rail sections that are adapted to be interconnected using a dowel.

The Bork Patent is a knock-down grind rail for skateboards and rollerblades. It is composed of at least two tubes held in alignment by tubular insert supports into opposing ends of the tubes. The tubes are clamped together end to end by a special, generally U-shaped clip having arms which are bent toward one another to form elbows. Supports are provided to support the tube above the ground.

The Kelsey Patent discloses a published patent application which is a grind rail and transport kit. It provides a portable and durable grind rail. To facilitate portability, the grind rail disassembles into rail pieces and stand pieces.

The Mills Patent is a collapsible grind bar. It is a collapsible rail glide or grind bard for use by skateboarders, in-line skaters and snowboarders. The device is collapsible and can be easily transported. As illustrated in FIGS. 7, 8, 9 and 10, the device essentially has a support structure which supports the grind rail above the ground so that an individual can grind the skateboard on it.

WIPO Patent WO 99/33526 is a traffic cone adapter kit. It is a system or kit for supporting cross bars on traffic cones using ring hanger 100 that fits onto the top of the cone and includes slots. A number of bracket slats can be hung from each slot. The brackets molded into the bracket slats hold the ends of the bars in shallow dished recessions, so that the bars are stable but are easily dislodged when kicked accidentally.

A need exists for a lightweight, portable, economical, relatively easily modifiable, easily assembled and disassembled grind rail system that can utilize the users choice of materials and can potentially extend the life of expensive skateboards, skates and grind shoes. Such a system would help accommodate the needs of grinders at all skill levels who need varying levels of difficulty and or varying levels of safety provided by underlying surfaces. Such a system would help lessen the use of existing public and private stair rails, curbs, benches and other potential grind surfaces. The consumer has their choice of tubular materials for this application. What is needed is a type of support that can be quickly and easily attached to tubes which provides the method of attachment without the need of tools and also provides a support structure to hold the tube above an underlying surface. Such a tube support would also make it possible for consumers to purchase inexpensive, readily available PVC tube materials, bend them into arcs to form new kinds of grind rail trajectories and support these with multiple easy to install supports that can be placed strategically along their custom formed rail in the placement of their choosing.

SUMMARY OF THE INVENTION

The Skate Activities Rail Support invention allows a quick-connect, snap-fit of a support device to a tubular rail which used in multiples will create an assembly that holds a tube so that it's top exposed surface can be used as a grind surface by grinders, skaters and skate boarders.

Though steel tube can be used with this quick-connect device, it is primarily intended to allow usage of plastic schedule 40 rigid PVC or other plastic conduit as the grind surface. Multiple Skate Activities Rail Supports affixed to the bottom of a rail can be placed in various locations as needed to provide more instances of support required through the use of plastic tubing as a grind rail surface. The assembled grind rail structure can be interconnected or secured to additional similar grind rail structures to form a continuous grind rail structure of a desired length.

The Skate Activities Rail Support mechanically connects to plain tubes without use of hardware, bonding compound or tools by clipping with a snap fit around a large portion of the tubes outer surface circumference and provides a stable support that elevates the tube above an underlying surface that it sits upon. The aspect that clips around the circumference of the tube does so by extending above the half circumference line on both sides of the tube and continuing upward following the diameter of the tube circumference to an extent that creates an encirclement of over half the tube circumference. These upward extensions may intrude into the area of the tube that occasionally comes in contact with a grind component that is being slid upon it. Therefore the leading and trailing edges of the clip aspect are rounded to help upwardly deflect forces that are struck against it reducing unwanted braking forces.

Connection of a number of supports aligned along the bottom of a tube in more quantity than is necessary when used with rigid metal tube make possible the use of plastic tube which is less structural such as schedule 40 rigid PVC conduit tube material. It also makes it possible to effectively support a rail which is curved along a custom trajectory.

The ability to utilize PVC conduit for a grind rail surface offers benefits to the consumer. The use of the PVC conduit will extend the service life of athletic equipment that is slid across it. Even if the surface becomes marred, the hardness of the material will not allow for creation of a cutting or filing surface that rapidly wears the bottom or skateboards, skates and grind shoes or other athletic equipment. If the surface that is oriented to the top of the PVC conduit becomes too worn to be desirable for a grind surface, The Skate Activities Rail Support allows the conduit to be rotated as many degrees as necessary to reveal an unworn section of its surface. This allows the user to "refresh" the grind surface of their grind rail structure while still using the same section of tube. PVC conduit can be easily cut to desired length with common tools the consumer is familiar with. PVC conduit can be easily heated with a common heat gun and therefore bent to create curves which change the trajectory of the grind rail surface. PVC conduit is lightweight, inexpensive and readily available in comparison to metal tubing or forms. The tube support assembly can be made out of plastic or metal.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1A:
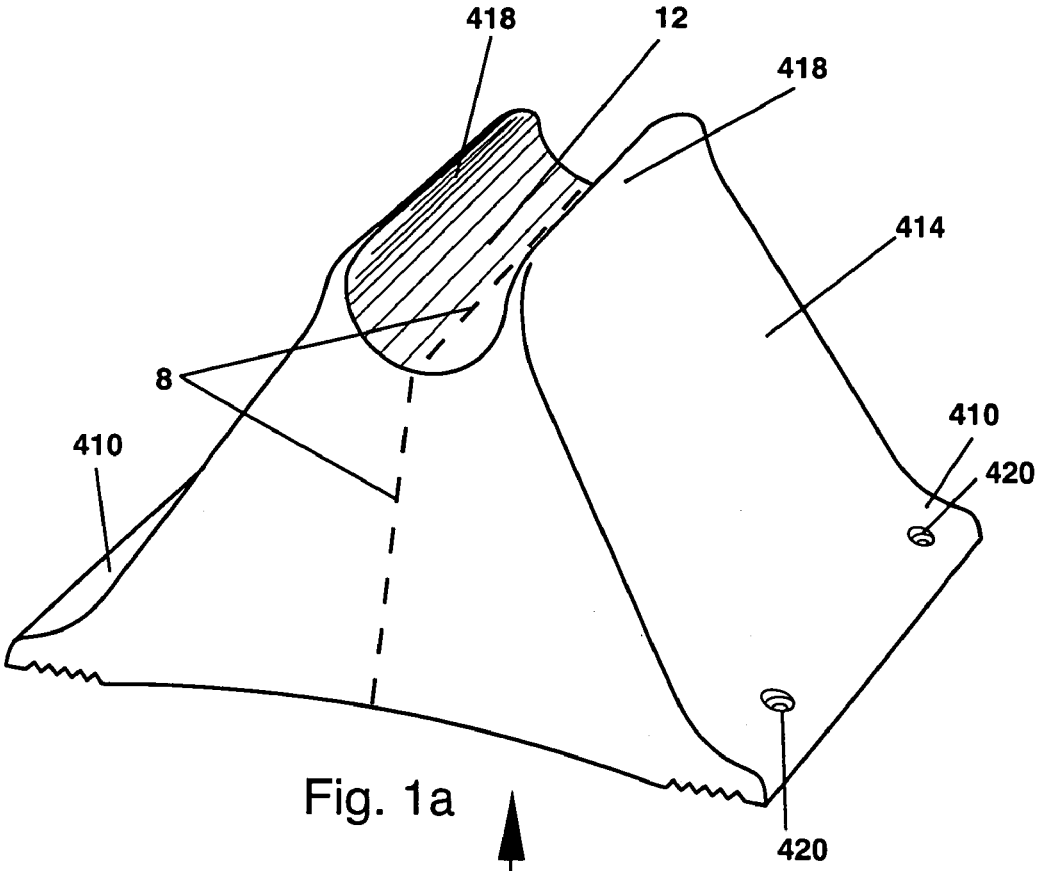
FIG. 1*a* is a perspective view of one embodiment of the invention disclosed herein.
Figure 1B:
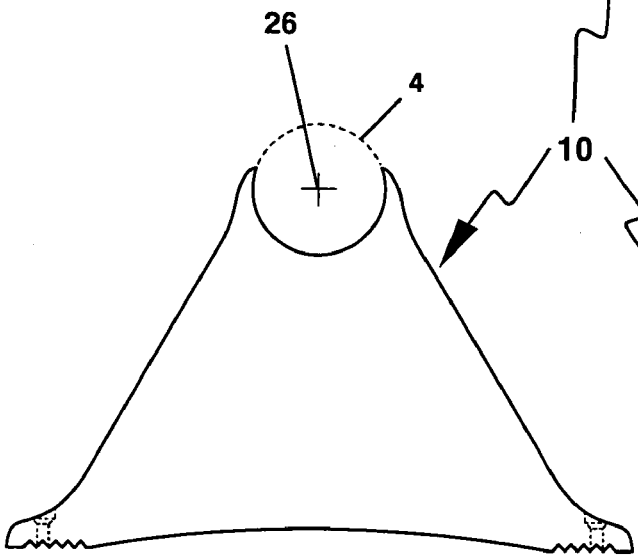
FIG. 1*b* is an end view of one embodiment of the invention disclosed herein.

FIG. 1 is a perspective view of one tube support embodiment 10 of the invention disclosed herein that shows the tube-receiver surface 12 as one surface detail of form 10 that also has as aspects of its form 12 gripping forms 418 which create a snap fit to greater than half the diameter of a tube that may be seated into surface 12. The gripping forms continue outward and downward to form a tapering body 414 which may flatten into flanges 410 at its distal extent from the longitudinal centerline 8 of surface 12. Counter sunk through holes 420 are located in flange 410 to facilitate use of hardware to affix embodiment 10 to an underlying surface as an optional attachment method in addition to simply resting on an underlying surface. Tube support embodiment 10 can be made of any variety materials but is preferably made with plastic such as high-density polyethylene (HDPE) which is well known in the art. Its function is to have multiples of its type assembled with a length of tube to hold that tube in such a way as to create a secure grind rail structure for use as a grind surface for skate borders, skaters and grinders. FIG. 1*b* is an end view of embodiment 10 of the invention showing centerline 26 which indicates the center longitudinal axis of a tube that is intended to be joined with embodiment 10. Dashed Arc line 4 indicates the uppermost extent of the top surface of a tube that is intended to be joined with embodiment 10.

Figure 1C:
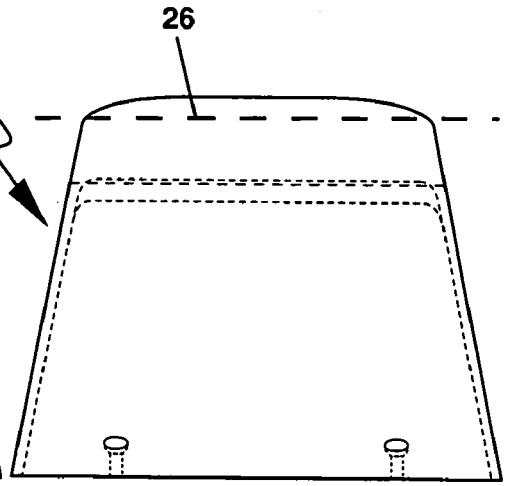
FIG. 1*c* is a side view of one embodiment of the invention disclosed herein.

FIG. 1*c* is a side view of embodiment 10 of the invention showing a side view of centerline 6 which indicates the center longitudinal axis of a tube that is intended to be joined with embodiment 10.

Figure 2:
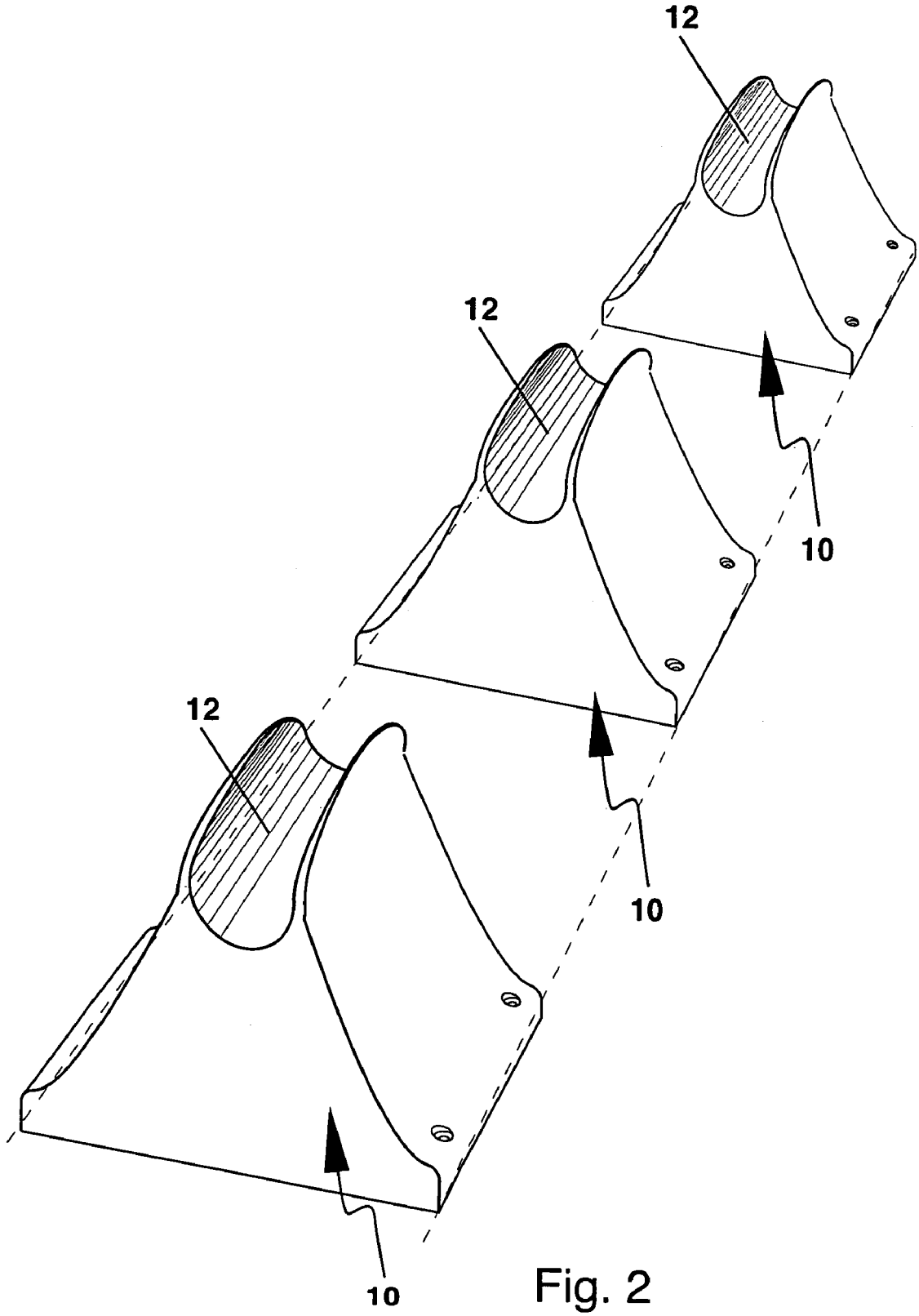
FIG. 2 is a perspective view of multiple copies of one embodiment placed equidistantly or at changing distances along a straight line in preparation for assembly of tube into the top tube-receiving surfaces.

FIG. 2 is a perspective view of multiple copies of one embodiment 10 placed equidistantly or at changing distances along a straight line with the tube receiving surfaces 12 aligned in preparation for assembly of a tube into the top tube-receiving surfaces 12. The Skate Activities Rail embodiment 10 can also be snapped onto a curved rail in more numbers to give increased support to these rail configurations which can be more unstable due to the riders increased side-load on them while grinding around a curve.

Figure 3:
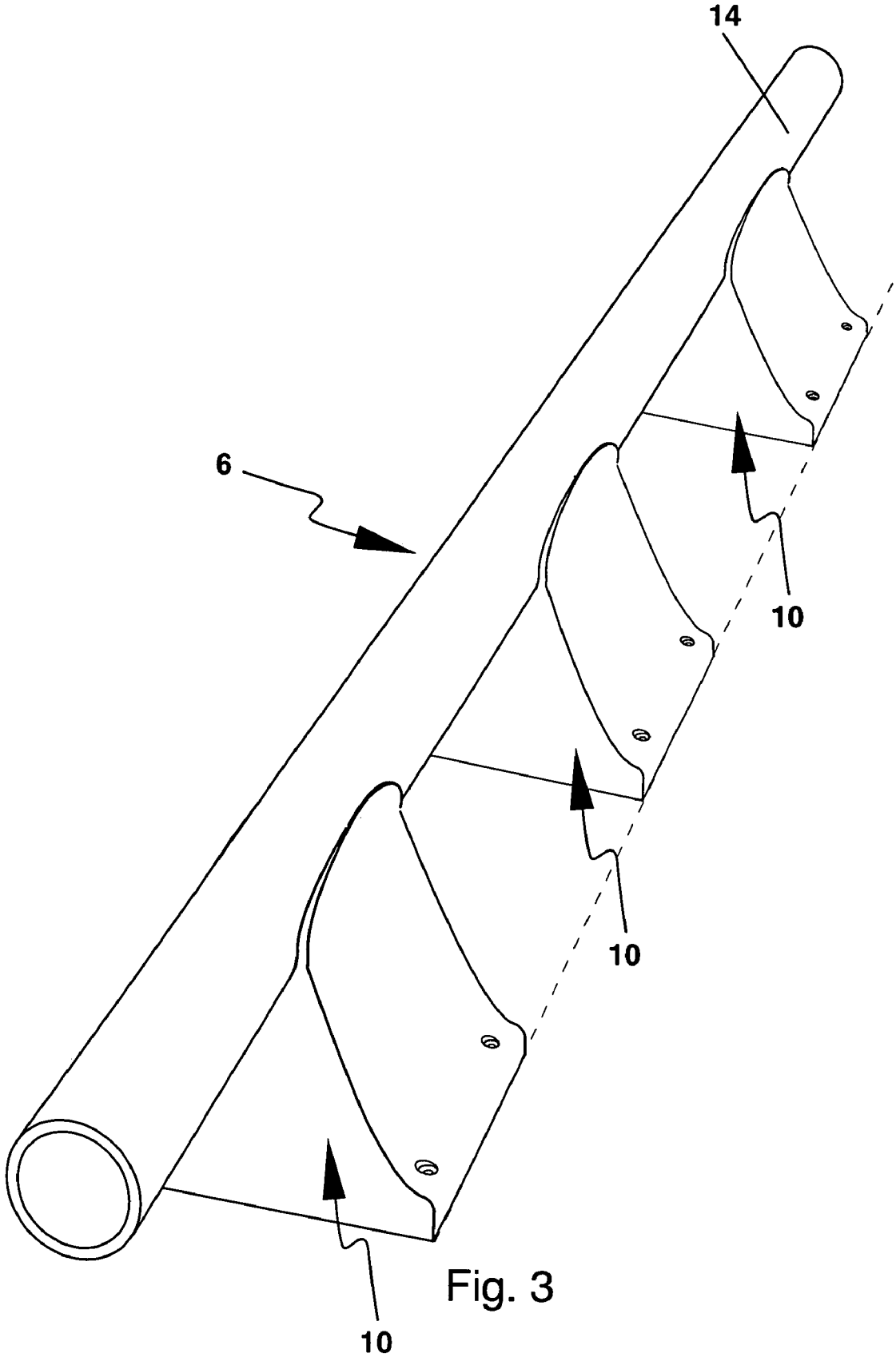
FIG. 3 is a perspective view of multiple copies of one embodiment placed equidistantly or at changing distances along a straight line with a tube assembled into the top tube-receiving surfaces.

FIG. 3 is a perspective view of multiple copies of embodiment 10 placed equidistantly or at changing distances along a straight line with a tube 14 assembled into the top tube-receiving surfaces. This is the simplest expression of the Skate Activities Rail Support as represented by embodiment 10, in its intended use as assembled with a tube 14 to create a grind rail structure 6. While only one tube 14 is illustrated in FIG. 3, it will be appreciated that it is within the spirit and scope of the present invention to have a multiplicity of interconnected tubes supported by said multiplicity of tube supports 10 so that the grind rail structure 6 can be extended for any desired length.

Figures 4A, 4B:
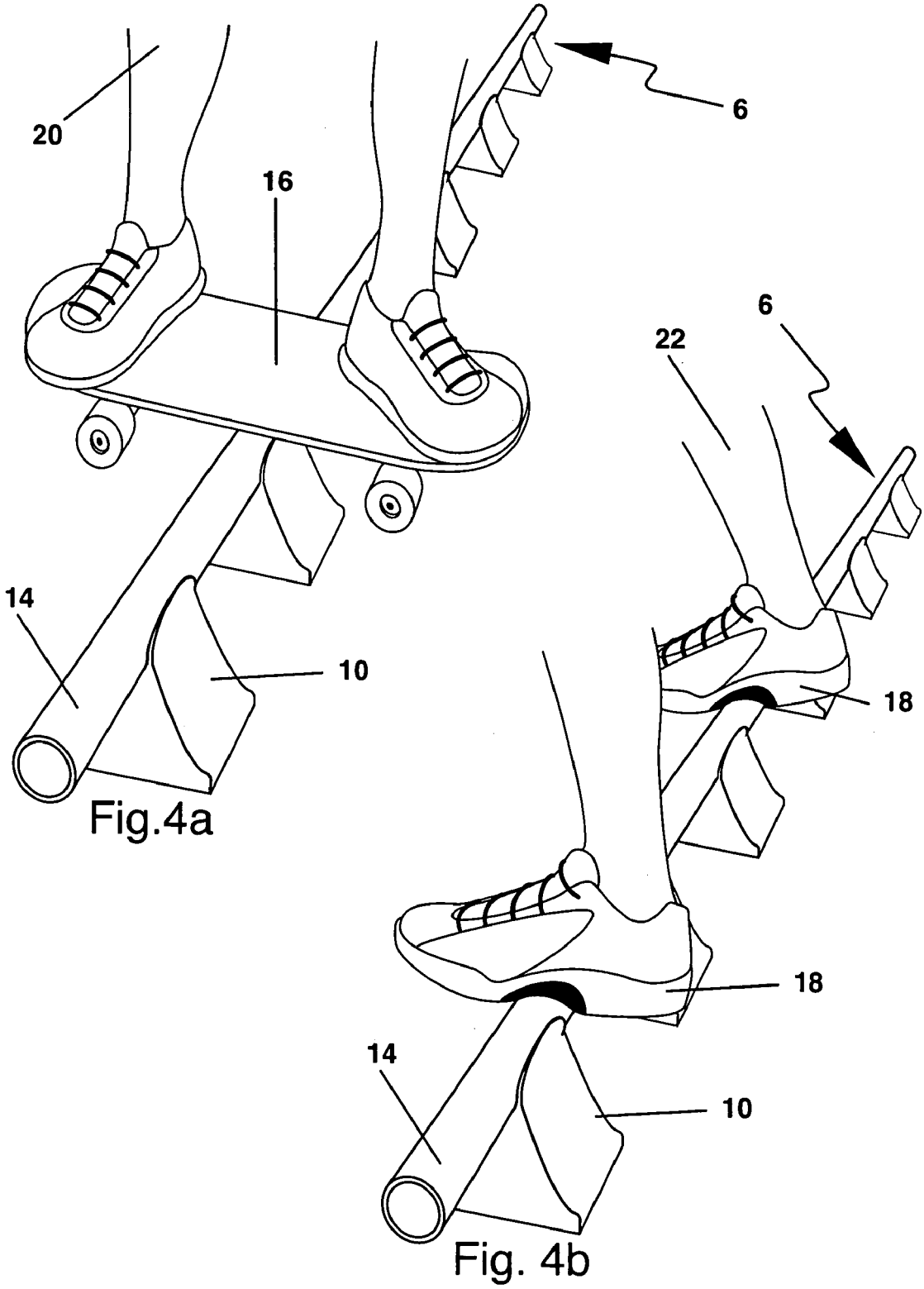
FIG. 4*a* is perspective view of a skate boarder utilizing an assembly, which uses the invention disclosed herein.
FIG. 4*b* is perspective view of a grinder utilizing an assembly, which uses the invention.

FIG. 4*a* is perspective view of a skate boarder 20 utilizing an assembly of multiples of an embodiment of the invention 10 with a tube 14, which form a grind rail structure 6. The skate boarder 20 may perform stunts on the grind rail structure 6 by accelerating towards the grind rail structure 6, popping their skate board 16 up and landing a bottom surface of the skateboard 16 on the grind rail structure 6. They will continue grinding down the grind rail structure 6 by maintaining their balance on the skateboard 16 which is teetering across grind rail structure 6. Frictional forces between skate board 16 and the grind rail structure 6 may either allow the skateboard 16 to be slid the entire length of the grind rail structure 6 or require a dismount of the skate board from the grind rail structure. The structure of the Skate Activities Rail Support 10, use of multiple of embodiment 10 attached from 6 inches to 20 inches apart along the bottom of a suitable tube 14 which can be metal but will preferably be 2" outer diameter Schedule 40 PVC plastic rigid conduit will create a sufficient structure to withstand the forces and support the weight of skate boarders, skaters, and grinders.

FIG. 4*b* is perspective view of a grinder 22 utilizing an assembly of multiples of an embodiment of the invention 10 with a tube 14, which form a grind rail structure 6. The grinder 22 may perform stunts on the grind rail structure 6 by accelerating towards the grind rail structure 6, jumping on to the rail wearing grind shoes 18, such as those disclosed in U.S. Pat. No. 5,970,631. By aligning the hemi cylindrical rigid grooves that are mounted on the bottom of the grind shoes 18 with the length of the grind rail structure 6, the grinder 22 can control his or her slide along the top of the grind rail surface. The grinder 22 will continue grinding down the grind rail structure 6 by maintaining his/her balance. Frictional forces between the grind shoes 18 and the grind rail structure 6 may either allow the grinder 22 to slide the entire length of the grind rail structure 6 or require a dismount from it.

Figure 5A:
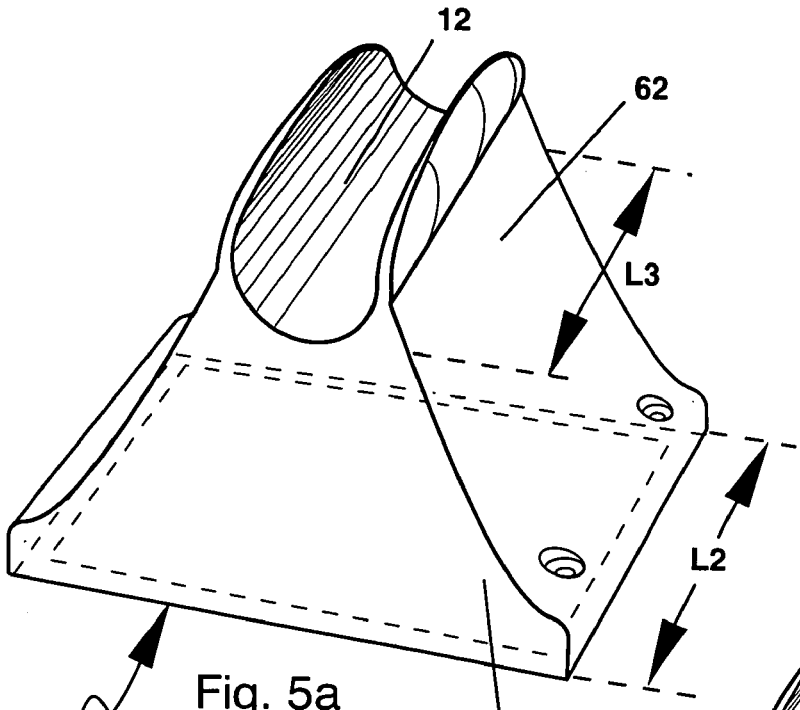
FIG. 5*a* is a perspective view of one embodiment of the invention showing a hollow center surrounded on all 4 sides by vertical walls that extend upward to connect to the top tube-receiver surface. Each of these vertical walls is at a diagonal to facilitate stacking copies of the embodiment on top of each other.
Figure 5B:
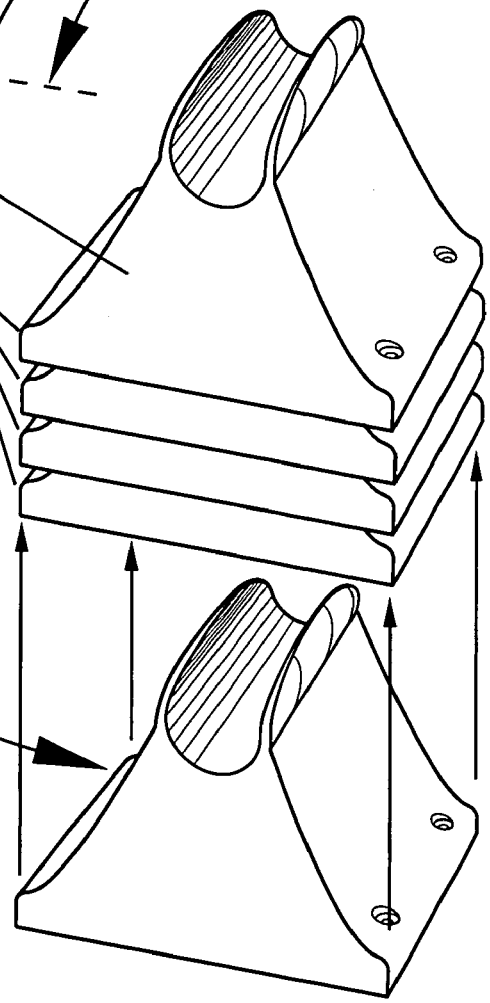
FIG. 5*b* is a perspective view of one embodiment of the invention showing its ability to stack identical embodiments on top of another.

FIG. 5*a* is a perspective view of embodiment 10 of the invention showing a hollow center surrounded on all four sides by vertical end walls 56 and side walls 62 that extend upward to connect to the top tube-receiver surface 12. The vertical end walls 56 on either end of embodiment 10 would have a slight diagonal trajectory that would tilt inward making embodiment 10 longer at the base L2 than at the longitudinal ends L3 of the tube-receiver surface 12. As shown in FIG. 5*b*, this execution allows ability to stack multiples of the same embodiment 10 together by inserting the top of one embodiment 10 into the hollow center of the bottom of another embodiment 10. Stacking Skate Activities Rail Supports in this manner would positively effect the overall volume required for packaging individual sets of components for consumer use by reducing the volume of space needed for packaging and render the individual components easier to transport.

Figure 6A:
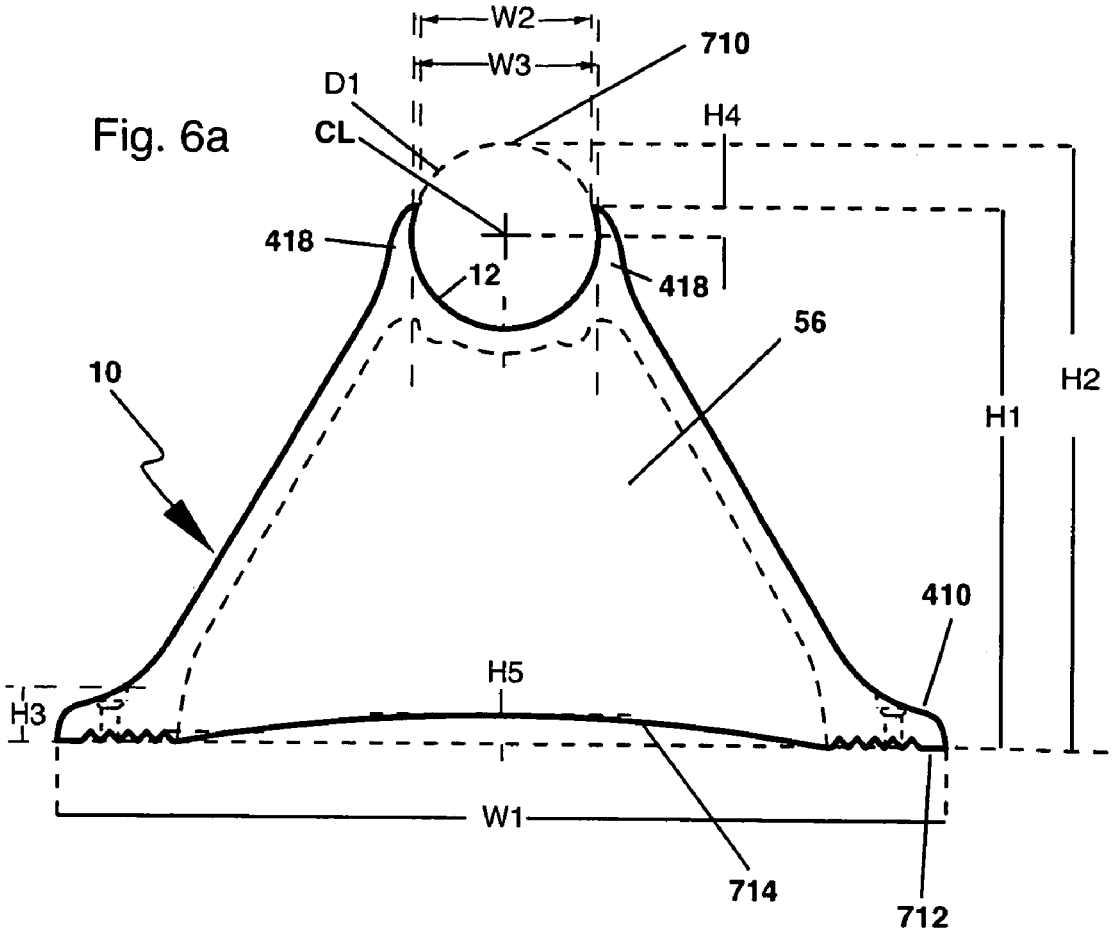
FIG. 6*a* is an end view of one embodiment of the invention showing its most desirable form and showing dimensions which are variable.

FIG. 6*a* is a end view of embodiment 10 of the invention showing dimensions which are variable in manufacturing to fine tune its user interface. The tube receiver surface 12 has a diameter D1 that is determined by the diameter of the tube that will be installed into the tube receiver surface 12. The curved, vertical gripping forms 418 on each side of the tube receiver surface 12 extend past the centerline CL of their diameter D1 as indicated by height H4. Gripping forms 418 extended to height H4 provides the clipping interference fit to the installed tube that will sit concentrically against the tube receiver surface 12 by creating a narrower distance between widths W2 than width W3. Additional embodiments may require that height H2 be larger or smaller to affect the distance of the top of the grind rail structure 710 to the underlying surface the assembly sits upon. Height H3 may also be required to be of differing thickness to respond to engineering criteria. Width W1 may also be required to be of differing dimension to respond to engineering criteria. Vertical end walls 56 at both ends of embodiment 10 may have an upward arched or concave bottom edge 714 to help ensure that embodiment 10 is resting on and supported by its bottom surface 712 under flange 410 which create the widest extent of the base structure.

Figure 6B:
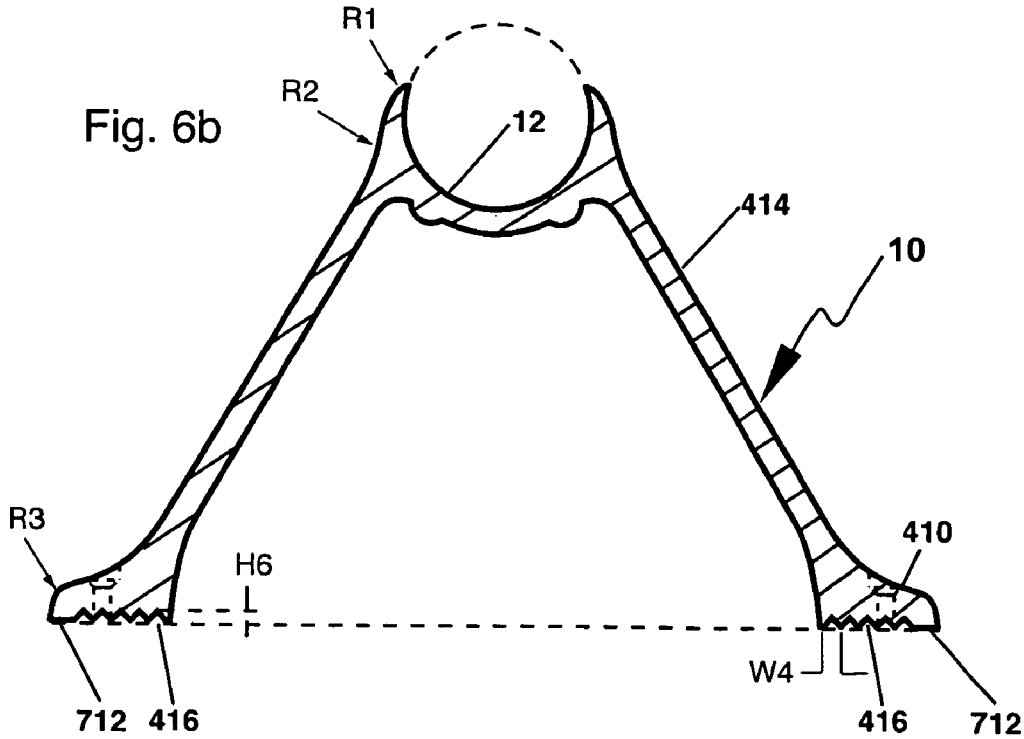
FIG. 6*b* is a cross sectional view of one embodiment of the invention showing additional embodiment detail variables which may be utilized to improve its function.

FIG. 6*b* is a cross sectional view of embodiment 10 of the invention showing additional embodiment details which may be utilized to improve its function. Radii R1 and R2 may be added in response to engineering criteria. Radius R2 may be added to surface 414 to create more clearance for differing types of athletic equipment that is intended to utilize the grind rail structure as demonstrated in FIGS. 4*a* and 4*b*. Traction notches 416 in bottom surface 712 may have a differing height H6, differing width W4 and differing number of instances across bottom surface 712.

Figure 7:
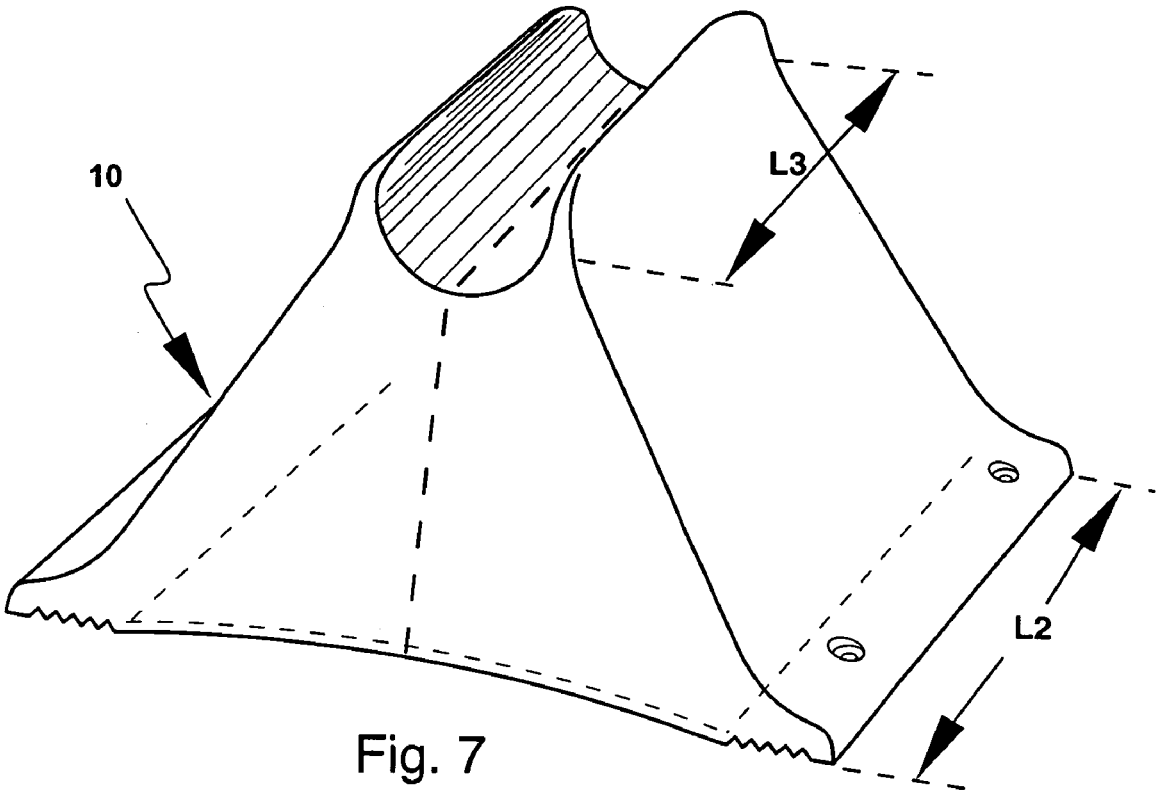
FIG. 7 is a perspective view of one embodiment of the invention with base length indication and tube receiver surface length indication.
Figure 8A:
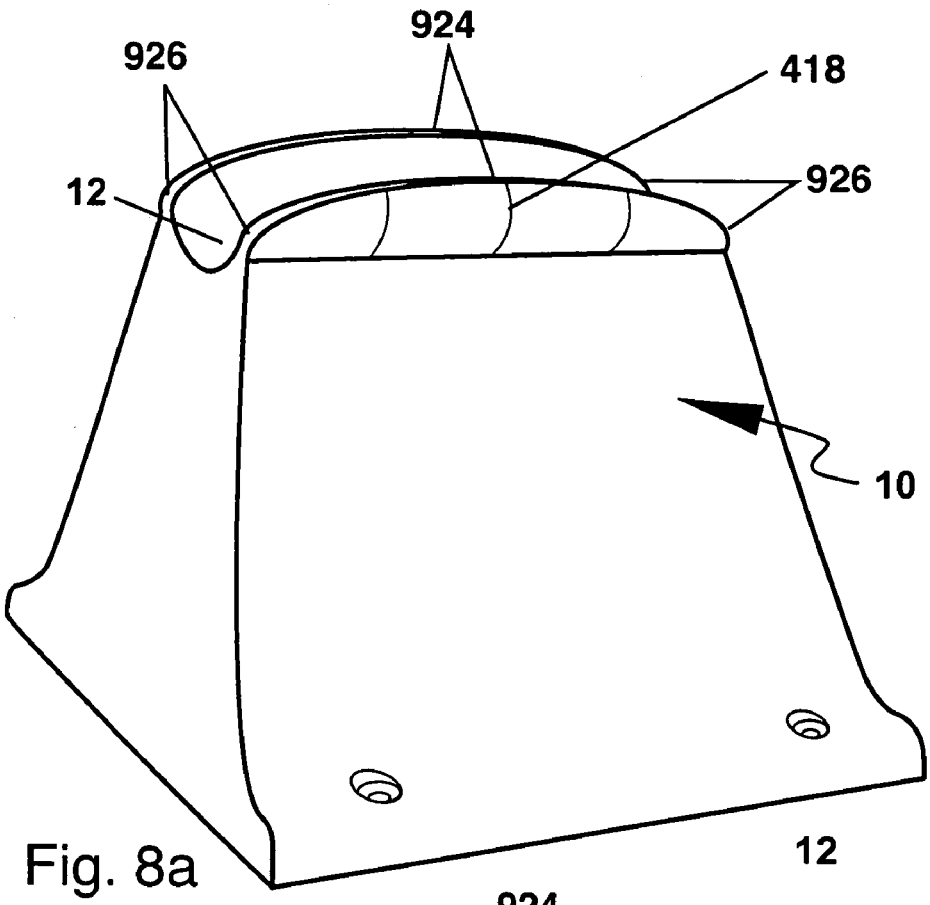
FIG. 8*a* is a perspective view of one embodiment of the invention with longitudinally curved edges of the top tube receiver.

FIG. 7 is a perspective view of one embodiment 10 of the invention with base length indication and tube receiver surface length indication;

FIG. 8*a* is a perspective view of embodiment 10 of the invention with longitudinally curved edges 924 on the top of gripping forms 418 on the sides of tube receiver surface 12. The leading and trailing edges 926 on either end of the longitudinal curved edges act as contact points and guides for the leading edges of devices that impact them. If a device contacts the leading edge 926 of embodiment 10, it will be directed upward and gradually follow the curved edges 924 until moving away from embodiment 10.

Figure 8B:
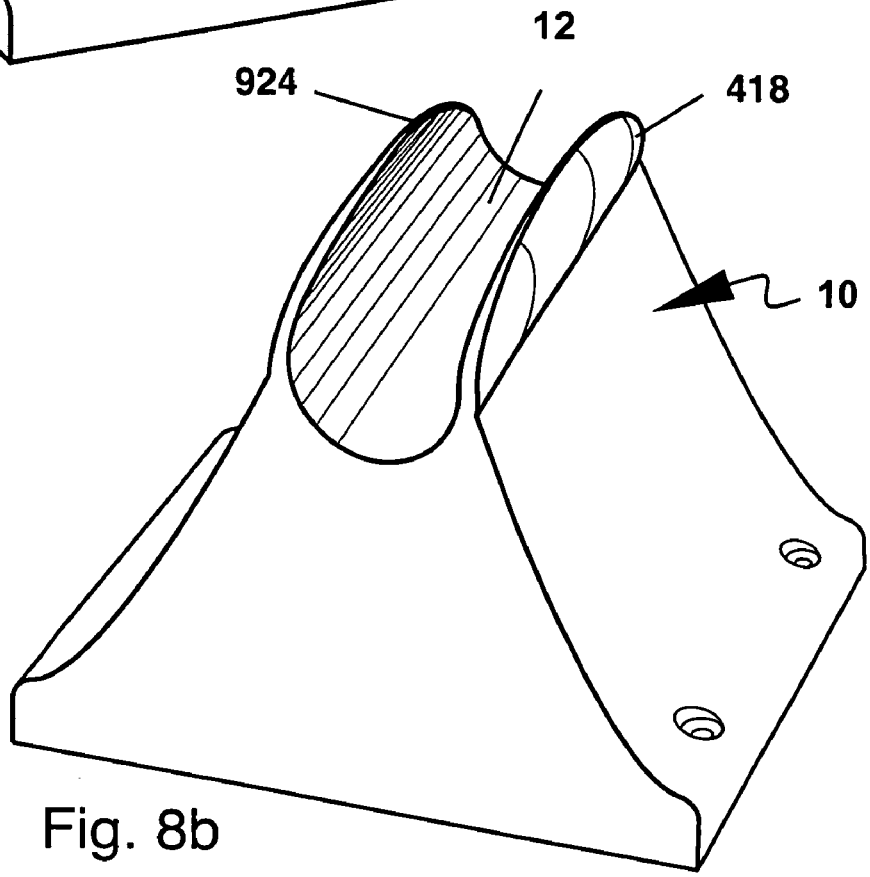
FIG. 8*b* is another perspective view of one embodiment of the invention with longitudinally curved edges of the top tube receiver.

FIG. 8*b* is another perspective view of embodiment 10 of the invention with longitudinally curved edges 924 on the top tube receiver.

Figure 8C:
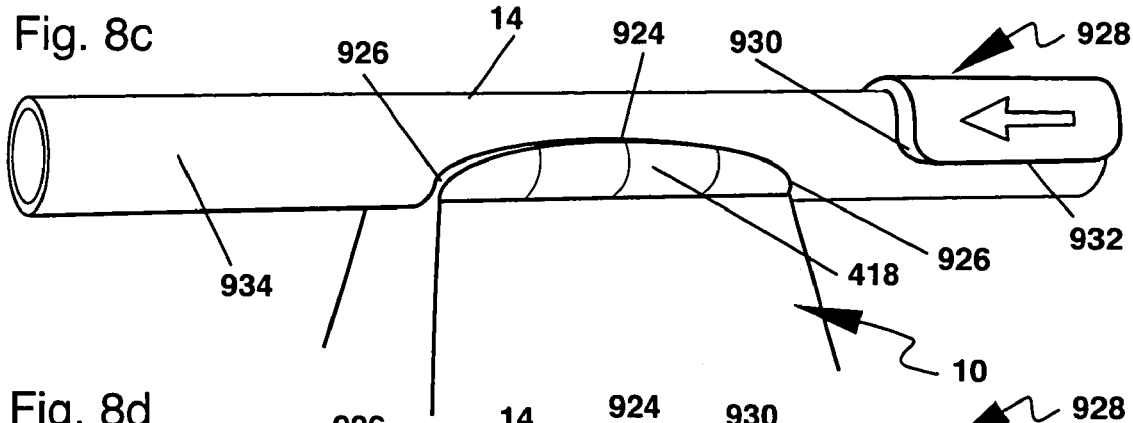
FIGS. 8*c*, 8*d*, 8*e*, 8*f* illustrate a series of figures that show a progression from right to left of a device that is being slid along a tube and is rotated downward too far on a side of the tube, how the device contacts an embodiment of the invention and how the device is deflected upward and continues along the tube in a better sliding position.
Figure 8D:
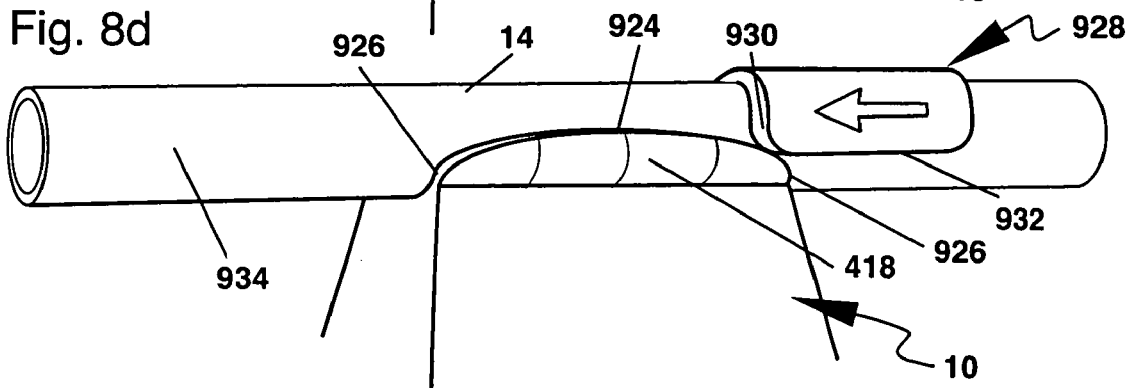
Figure 8E:
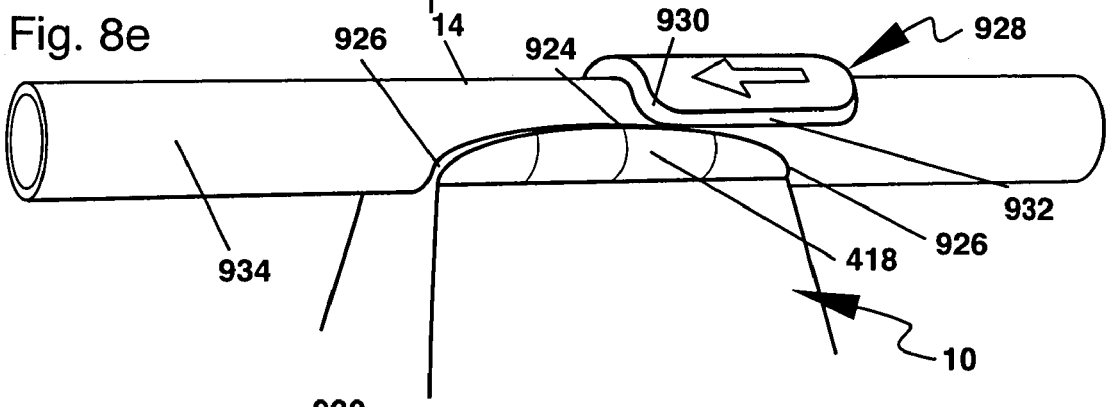
Figure 8F:
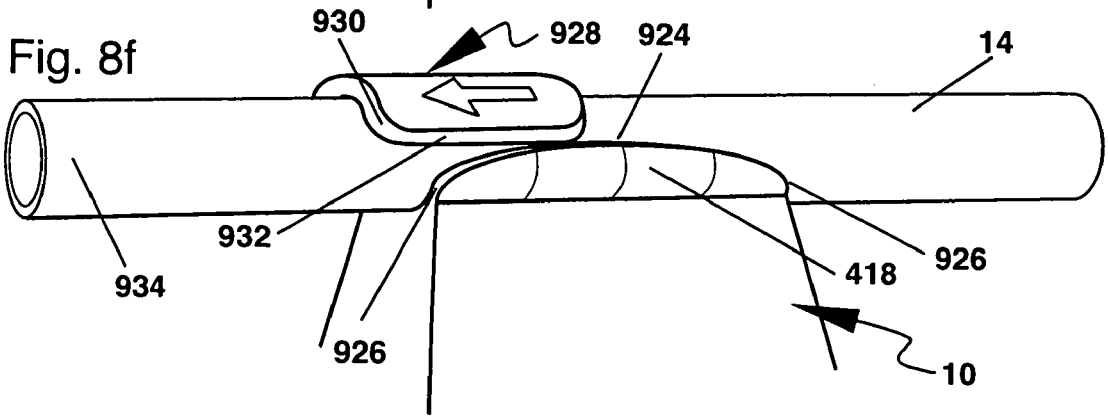

FIGS. 8*c*, 8*d*, 8*e*, 8*f* illustrate a series of figures that show a progression from right to left of a device 928 that is being slid along a tube 14. FIG. 8*c* shows the device 928 as rotated too far downward on the foreground side 934 of the tube 14 which will cause it to impact the tube gripping forms 418 as it travels from right to left towards embodiment 10. FIG. 8*d* shows the device 928 impacting its leading edge 930 with the leading edge 926 of the tube gripping form 418. FIG. 8*e* shows the device 928 deflecting upward and rotating around the circumference of the tube 14 as the device's 928 lower edge 932 rests upon or is otherwise guided by curved edge 924 of the tube gripping form 418. FIG. 8*f* shows the device 928 continuing towards the left as it slides across tube 14, now in an optimal degree of rotation around the circumference of tube 14 which will decrease the occurrence of impacting another tube gripping form 418 further down the length of the tube 14. The gentle guiding characteristics of the leading edges 926 and curved edges 924 of the tube gripping form 418 help overcome the slowing effect of sudden impacts by modifying vertical edges that absorb but don't deflect impact into edges that are gently arched at angles away from the direction of impact. This acts to divert impact energy from a device that hits the side of a Skate Activities Rail Support's tube gripping form 418 up and over it and to correct the device's orientation on the tube to optimize the grind speed potential by reducing the device's impact on successive Skate Activities Rail Supports.

Although the present invention has been described with reference to preferred embodiments, workers skilled in the art will recognize that changes may be made in form and detail without departing from the spirit and scope of the invention. The matters set forth in the foregoing description and accompanying drawings are offered by way of illustration only and not as limitations. Other applications and variations of the invention disclosed herein will become evident to those skilled in the art. The actual scope of the invention is intended to be defined in the following claims when viewed in the proper perspective based on relevant prior art.

Defined in detail, the present invention is a tube support to support a tube to be used as a grind rail, the tube having a centerline and a vertical height, the tube support comprising: (a) a base; (b) a tube receiver surface on said base; (c) a tube receiver mechanism to hold a tube on the tube receiver surface of said base through a snap fit wherein the vertical height of the tube receiver mechanism extends above the height of the vertical centerline of the tube to retain the tube on the tube receiver surface of said base; (d) whereby a multiplicity of spaced apart tube supports serve to retain the tube so that the tube is used as a grind rail.

Defined broadly, the present invention is a portable grind rail assembly comprising: (a) a cylindrical tube having a centerline and a vertical height; (b) at least two spaced apart tube supports, each tube support further comprising a base, a tube receiver surface on said base and a tube receiver mechanism to hold said tube on the tube receiver surface of said base through a snap fit wherein the vertical height of the tube receiver mechanism extends above the height of the vertical centerline of the cylindrical tube; and (c) said cylindrical tube supported at spaced apart locations on the cylindrical tube by a respective tube support.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A tube support to support a tube to be used as a grind rail, the tube having a centerline and a vertical height, the tube support comprising:

a. a base;

b. a tube receiver surface on said base;

c. a tube receiver mechanism to hold a tube on the tube receiver surface of said base through a snap fit wherein the vertical height of the tube receiver mechanism extends above the height of the vertical centerline of the tube to retain the tube on the tube receiver surface of said base; and d. said tube support further comprising a pair of sidewalls and a pair of end walls which surround the hollow space within said base;

e. whereby a multiplicity of spaced apart tube supports serve to retain the tube so that the tube is used as a grind rail.

2. A tube support in accordance with claim 1, wherein the base, the tube receiver surface and the tube receiver mechanism are all comprised of one piece.

3. A tube support in accordance with claim 1, wherein said base further comprises concave sidewalls below said tube receiver mechanism.

4. A tube support in accordance with claim 1, wherein the interior of said base is hollow.

5. A tube support in accordance with claim 1, wherein said base further comprises a bottom surface which is concave.

6. A tube support in accordance with claim 1, wherein said base further comprises a bottom surface having grooves.

7. A tube support in accordance with claim 1, wherein said tube receiving mechanism retains said tube while permitting said tube to be rotated on said tube receiver surface.

8. A tube support in accordance with claim 1, wherein said base further comprises flanges with vertical countersunk holes to facilitate affixing the tube support to an underlying surface with hardware fasteners.

9. A tube support in accordance with claim 1, wherein said base, said tube receiver surface and said tube receiver mechanism are made out of plastic.

10. A tube support in accordance with claim 1, wherein said base, said tube receiver surface and said tube receiver mechanism are made out of metal.

11. A tube support in accordance with claim 1, wherein said tube is made out of PVC conduit.

12. A portable grind rail assembly comprising:

a. a cylindrical tube having a centerline and a vertical height;

b. at least two spaced apart tube supports, each tube support further comprising a base, a tube receiver surface on said base and a tube receiver mechanism to hold said tube on the tube receiver surface of said base through a snap fit wherein the vertical height of the tube receiver mechanism extends above the height of the vertical centerline of the cylindrical tube;

c. said cylindrical tube supported at spaced apart locations on the cylindrical tube by a respective tube support; and d. each said tube support further comprises a pair of sidewalls and a pair of end walls which surround a hollow space within said base.

13. A portable grind rail assembly in accordance with claim 12, further comprising a multiplicity of spaced apart tube supports and a multiplicity of interconnected cylindrical tubes, the length of interconnected tubes supported along the interconnected length by said multiplicity of tube supports.

14. A portable grind rail assembly in accordance with claim 12, wherein said cylindrical tube is made of PVC conduit.

15. A portable grind rail assembly in accordance with claim 12, wherein each base of each tube support further comprises concave sidewalls below said tube receiver mechanism.

16. A portable grind rail assembly in accordance with claim 12, wherein the interior of each base of each tube support is hollow.

17. A portable grind rail assembly in accordance with claim 12, wherein the base of each tube support further comprises a bottom surface which is concave.

18. A portable grind rail assembly in accordance with claim 12, wherein each base of each tube support further comprises a bottom surface having grooves.

19. A portable grind rail assembly in accordance with claim 12, wherein each tube receiver mechanism retains said tube while permitting said tube to be rotated on said tube receiving surface.

20. A portable grind rail assembly in accordance with claim 12, wherein each tube receiver mechanism retains said length of interconnect tubes while permitting the length of interconnected tubes to be rotated on said tube receiving surfaces.

21. A portable grind rail assembly in accordance with claim 12, wherein each base of each tube support further comprises flanges with vertical countersunk holes to facilitate affixing the tube support to an underlying surface with hardware fasteners.

22. A portable grind rail assembly in accordance with claim 12, wherein the base, tube receiving surface and tube receiving mechanism of each tube support is made of plastic.

23. A portable grind rail assembly in accordance with claim 12, wherein said base, tube receiving surface and tube receiving mechanism of each tube support is made of metal.

* * * * *